United States Patent [19]

Perry

[11] 3,977,578

[45] Aug. 31, 1976

[54] CONTAINER WITH ATTACHED CLOSURE

[76] Inventor: Walter Merton Perry, 76 Locust Hill Road, Darien, Conn. 06820

[22] Filed: Oct. 17, 1974

[21] Appl. No.: 515,444

Related U.S. Application Data

[63] Continuation-in-part of Ser. No. 231,124, March 2, 1972, Pat. No. 3,843,011.

[52] U.S. Cl. ..... 222/541; 222/561

[51] Int. Cl.[2] ..... B65D 47/10

[58] Field of Search ..... 222/541, 561

[56] References Cited

UNITED STATES PATENTS

| | | | |
|---|---|---|---|
| 117,510 | 8/1971 | Brown | 222/541 |
| 2,274,752 | 3/1942 | Straub | 222/561 X |
| 2,320,484 | 6/1943 | Straub | 222/541 |
| 2,590,437 | 3/1952 | Maves | 222/561 X |
| 3,703,979 | 11/1972 | Douty | 222/541 |
| 3,843,011 | 10/1974 | Perry | 220/269 X |
| 3,856,184 | 12/1974 | Luviano | 222/541 X |

*Primary Examiner*—Allen N. Knowles
*Assistant Examiner*—Hadd Lane

[57] ABSTRACT

Improved easy opening means for containers. Especially adapted to those used for liquids, including carbonated beverages, and permitting drinking from the container or pouring out contents. An important feature is attachment of closure to container after opening to avoid litter. One closure design has lift tab attached to the closure for easy opening, and with closure sealed by either a frangible adhesive sealant or by membrane sealing means. Lift tab initiates rupture of sealant, and then both lift tab and closure are pushed below container top with means to hold tab below opening so there is no interference when drinking from the can. Another closure has a small end for initial pressure release and starting rupture of sealing means, and then whole closure hinges inwardly. Still another means comprises a slide gate with frangible membrane for sealing and for very easy opening. Slide gate is non-detachable and has sharp points for easier rupture of membrane during opening. Optionally a pressure release button is provided to release internal pressure before pulling the slide gate. An improved forming method for making the opening smaller than the closure where the closure is cut from the ductile metal top material. Partial use of score lines is included. Container top may be ductile metal including aluminum or steel, or of plastic for various forms of the invention. Primary objectives are the elimination of a separate closure device that would cause litter, closure easier to open than heretofore, low cost, and no danger of a piece coming loose inside container.

17 Claims, 43 Drawing Figures

CONTAINER WITH ATTACHED CLOSURE

This application is a continuation-in-part of my copending application Ser. No. 231,124, filed Mar. 2, 1972, now Pat. No. 3,843,011 issued Oct. 22, 1974.

BACKGROUND OF THE INVENTION

1. Field of the Invention

This invention relates to easy opening means which is provided in the end of a can or similar container, by which the can can be opened without resorting to a separate tool or device which is not part of the can assembly. It relates to easy opening means which remains attached to the container after opening. It is concerned particularly with containers for liquids which are normally consumed directly from the can, and which may be under internal pressure before opening.

2. Description of Prior Art

The opening means generally used heretofore results in a separate piece being completely removed from the can end, and which is then discarded. In the most common form, the can end is made of aluminum, and an openable segment is defined in the end by score lines, made by cutting the metal part way through in the outline of the removeable segment. A leverage ring shaped tab is usually attached to the inner end of the segment by an integral rivet. When the tab is raised, the high leverage breaks the score line at the small rivet end, and once rupture is initiated, the remainder of the segment is torn out by pulling on the tab. There are four principle disadvantages to this device. One is the sharpness of the opening left in the can end because of the torn metal, another is the damage to the environment when the piece is discarded, another is the danger to bare feet from the sharp segment if discarded on the ground, as at beaches, and a fourth is the cost of the extra metal for the lifting tab.

BRIEF SUMMARY OF THE INVENTION

It is a primary objective of the invention to provide an easy opening means for a container in which the closure element remains attached to the container so it will not be discarded separately. Another primary objective of the invention is to provide an opening method which is easy to operate and does not require much force. A further objective of the invention is to provide rounded edges in the opening to prevent cutting the finger when opening the container or the lips when drinking from the can.

A further objective of the invention is to form the closure for the opening from the metal of the container end itself, in order to save material, and to provide firm attachment of the segment to the container after opening. Another objective of the invention is to make the opening smaller than the closure element to resist internal pressure.

A further objective of the invention is to provide adhesively secured sealing means for the closure to give positive assurance against leakage under pressure, and with very little force required to open.

Another objective of the invention is to fold the closure element down into the can and to keep it attached to the can end so it does not drop down into the contents of the can.

Another objective of the invention is to provide means to protect against accidental opening during shipping and before use. A further objective is to provide leverage means to assist the opening operation for certain types of closure. One leverage means also has the further advantage that it is unnecessary to push the closure down into the can with the finger, with danger of it getting stuck in the opening.

A further objective of the invention is to provide means by which the closure can be cut from the can top, and then enlarged so when positioned on the underside of the opening, it will not push up through when the contents is under pressure. Also alternate means are shown for reducing the size of the opening instead or in addition.

Still another objective of the invention is to provide sealing means on the underside of the can top, comprising an easily broken metal foil patch with adhesive attachment to the top and airtight sealing.

Another objective of the invention is to construct the closure so it can be opened as a slide gate with sealing means underneath, and with the slide closure remaining mainly on the outside of the container, and attached to it after opening. Another objective of the invention is to seal the slide gate with a frangible membrane such as foil or aluminum or tin.

Another objective of the invention is to provide sharp downward projections on the slide gate to assist in cutting the membrane during opening. Still another objective of the invention is to form the grooved slides for the gate from the ductile material of the container top, whether aluminum or steel.

Another objective of the invention is to adhesively attach a separately formed slide assembly in the container top. Another objective of the invention is to provide a small pressure release opening which is ruptured before the slide is operated.

Another objective of the invention is to provide an elongated segment with one end smaller and arranged to be pushed down first to start rupture of the seal line and to release the pressure.

Another objective of the invention is to provide a tab attached to one end of an elongated segment for initial rupture by leverage, and the tab is then pushed in flush to complete the opening.

Another objective of the invention is to provide an improved method for reducing the size of the opening after the outline of the closure is first cut when forming the can end.

BRIEF DESCRIPTION OF THE DRAWINGS

Other objectives and advantages of the invention will become apparent from the description given in the specification and by reference to the following drawings.

DESCRIPTION OF THE PREFERRED EMBODIMENTS OF THE INVENTION

Figure 1:
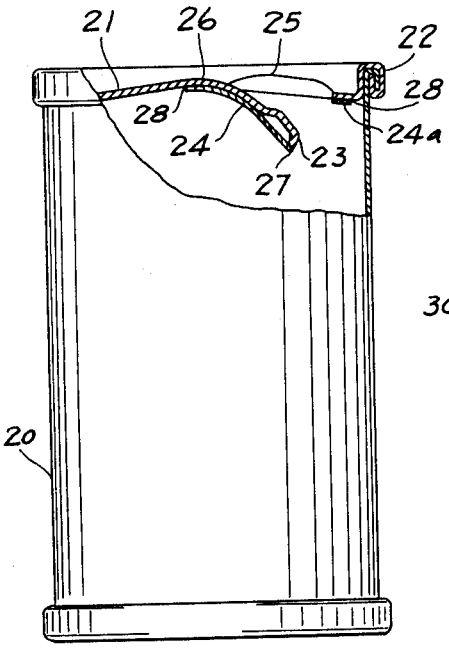
FIG. 1 is an elevation of a container with a closure shown in cross-section which is made in accordance with this invention, and which is shown in the opened position, with the closure remaining attached.

Referring now to the drawings, FIG. 1 illustrates a typical can or container with an opening device in accordance with my invention and shown in its opened position. The container wall 20 is fastened to the top 21 by rolled joint 22. The openable segment 23 is shown bent down and still attached to the can top by uncut part 26. The raised boss on the tab assists in pushing the segment down to open, cutting the aluminum foil sealing patch 24, which is held and sealed to the can top by circle of adhesive 28. The tab has a sharp edge 27 to more easily start cutting the foil, leaving strip 24*a* of the foil on the can top. Raised tab 25 serves to support one edge of the tab against internal pressure in the can.

Figure 2:
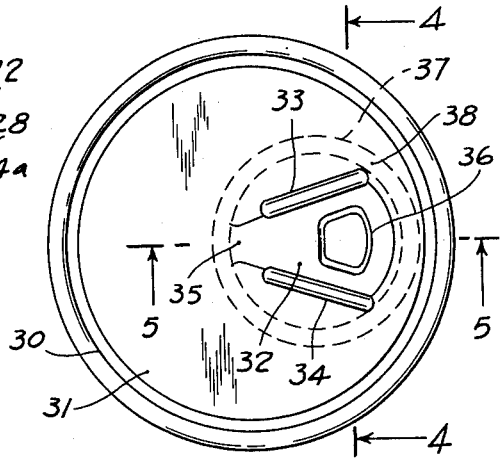
FIG. 2 is a plan view of a container showing one type of closure arrangement in the closed position, and which is in accordance with this invention.
Figure 3:
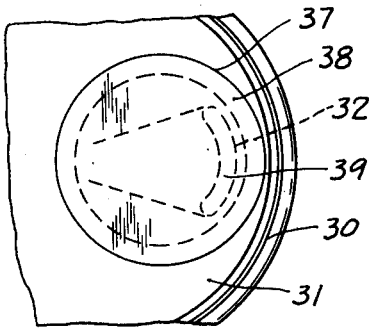
FIG. 3 is a view of the FIG. 2 type of closure, but viewed from the under side of the can top.

FIG. 2 shows an end view of can 30 with top 31, raised ribs 33 and 34 on the top alongside and overlapping the tab, raised boss 36 on the tab, tab 32 which is punched cut from the top 31, except for connecting strip 35, and sealing patch 37 underneath where it is fastened and sealed to the underside of top 31 by adhesive ring 38. FIG. 3 is a view of the underside of the cover showing patch 37, adhesive ring 38, tab 32 and supplementary adhesive area 39. Patch 37 may preferably be of aluminum foil, and the adhesive may be of the hot melt type. By adhesively attaching the patch to the tab at 39, the patch is cut away more cleanly when the tab is depressed to open. The patch of aluminum foil is air-tight to prevent leakage, and since the tab cannot move up under internal pressure, it serves to support the foil also against rupture from internal pressure.

Figure 4:
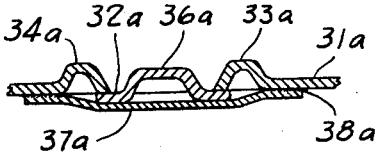
FIG. 4 is a cross-section taken along line 4—4 of FIG. 2.
Figure 5:
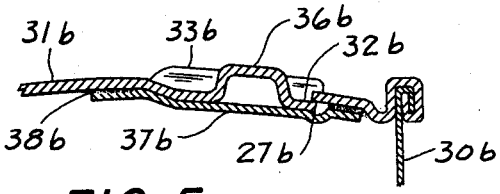
FIG. 5 is a cross-section taken along line 5—5 of FIG. 2.

FIG. 4 is a cross-section taken along line 4—4 of FIG. 2, and shows overlapping raised ribs 33*a* and 34*a*, and tab 32*a* with boss 36*a*. The aluminum foil patch 37*a* is held by adhesive ring 38*a*. FIG. 5 shows a cross-section taken along line 5—5 of FIG. 2, with the tab in the closed position, and with can wall 30*b*, can top 31*b*, tab 32*b* with boss 36*b*, rib 33*b*, and patch 37*b* held by adhesive line 38*b*. The can is opened by pushing down on the boss 36*b* of the tab 32*b*, the sharpened protruding edge 27*b* of the tab cutting the aluminum foil with very little effort.

Figure 7:
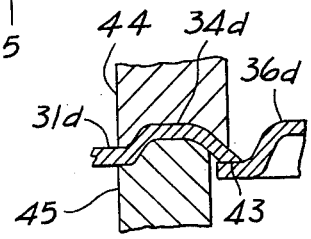
FIG. 7 is a cross-section showing the second step in forming the ribs for the FIG. 2 closure to make the opening smaller than the tab closure piece.
Figure 8:
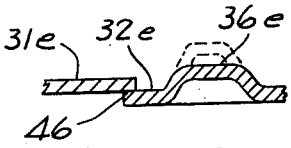
FIG. 8 is a cross-section showing an alternative method, in which the tab is made wider than the opening in the can top.

As shown in FIG. 4, the tab is wider than the opening in the top to resist inner pressure in the can from raising the tab or straining the aluminum foil. Since the tab is cut from the can top, and would be slightly smaller than the opening, a sequential pressing operation is required as shown in FIG. 6, 7 and 8, to either reduce the width of the opening, or increase the width of the tab.

Figure 6:
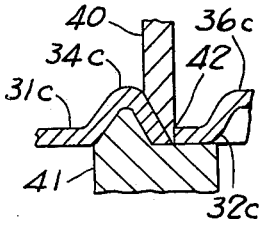
FIG. 6 is a cross-section showing the method of cutting the closure tab from the can top for the type of closure shown in FIG. 2.

FIG. 6 is a cross-section through a rib and the adjoining edge of the tab, similar to FIG. 4, and shows the method of forming. An upper die cutting blade 40 has cut rib 34*c* from tab 32*c* at 42, and opposing die member 41 supports the piece while it is being cut. This section can be taken along line 4—4 in FIG. 2. The tab boss is 36*c*. A second press operation is shown in FIG. 7 and is taken also along line 4—4 of FIG. 2. A press die 44, with opposing die 45, lowers and spreads the previously formed narrow rib to width 34*d*, so the right edge of the rib moves over to overlap the tab at 42. The tab boss is 36*d*. An alternative way to make the width of the tab greater than the opening in the top is shown in FIG. 8. In this case the boss on the tab is initially formed higher than required and the crown lowered to 36*e* in a second pressing operation, spreading the tab 32*e* width to overlap the opening in cover 31*e* at 46. These views show the operation for one edge, and the other edge of the tab is formed the same, simultaneously. The can top is made of relatively soft aluminum, and formation of ribs by pressing does not significantly reduce the strength of the top, even though the thickness of the metal is reduced to a small degree. Actually the ribs increase the rigidity of the top.

Figure 9:
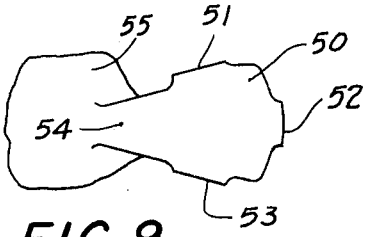
FIG. 9 is a plan view of a portion of a can top in which the closure tab is widened in several places by pressing.

FIG. 9 shows another way to cut the tab from the top of the can, and to enlarge its area so when positioned under the can top it resists internal pressure. A tab 50 is cut from top 55, and has three extensions 51, 52 and 53 around its periphery, which are formed by impact in a press, spreading the metal in the tab outwardly to form the projections, as shown. The tab remains attached to 55 at 54.

Figure 10:
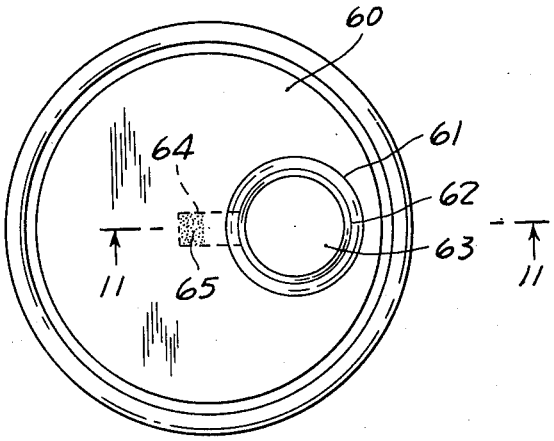
FIG. 10 is a plan view of a can top incorporating an alternative method of constructing a button type closure, with a plug and gasket arrangement.
Figure 11:
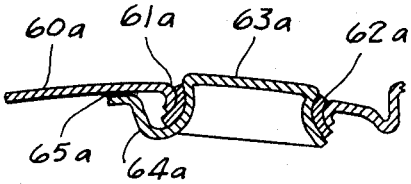
FIG. 11 is a cross-section taken along line 11—11 of FIG. 10.

FIG. 10 show a plan view of a can top with an alternative method of constructing a plug closure in keeping with this invention. FIG. 11 is a cross-section taken along line 11—11 of FIG. 10.

Referring to FIG. 11, a round opening 61*a* with curved edges is press formed in the top 60*a* of the can. A plug 63*a* is made of aluminum and a circular gasket 62*a* is adhesively attached to the plug. The gasket may be of polyvinyl chloride. The plug is sized to fit snugly in the hole with the gasket forming the seal. Pressure from inside the can increases the sealing effect. The plug should be formed to give resilience to compression, and it should have an extending tab 64*a* which is adhesively secured to the underside of the can top by adhesive 65*a*. When the plug is pushed in to dispense the can contents, it swings down and is held from dropping by the tab extension. The plug 63*a* can also be plastic.

FIG. 10 shows this design in plan view. The can top 60 has opening 61 filled by plug 63 and sealed by gasket 62. Extension 64 is held to the underside of the can top by adhesive 65.

Figure 12:
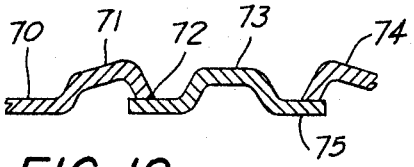
FIG. 12 is a cross-section showing still another configuration of the opening in the can and the tab for a FIG. 2 type of closure.

FIG. 12 shows a variation in forming the tab used in the design shown in FIG. 2. The can top 70 has two raised ribs 71 and 74 which have been spread inwardly to reduce the width of the opening so tab 75, which was cut from the metal of the top cannot move up through under pressure. In this variation the legs of the ribs are raised upward so the bottom of the tab and the bottom of the can end are level in line. 73 is a boss to facilitate pushing the tab down.

Figure 13:
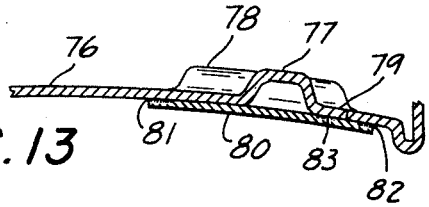
FIG. 13 is a cross-section showing the FIG. 2 configuration assembled in the can top.

FIG. 13 is a cross-section which shows the FIG. 12 configuration completed. Can end 76 has rib 78 which prevents the tab from moving up by overlapping its long edge. 80 is an aluminum foil patch under the openable area. It is sealed by hot melt adhesive ring 81 and 82. The tab 79 is flush with the can top, and it has boss 77. The aluminum foil is also adhesively attached to the underside of the tab at 83 to insure the right hand edge of the tab shearing the aluminum foil when it is pushed down, and preventing the foil from stretching and slipping rather then cutting through at the outer end of the tab to leave the opening clear of foil.

Figure 14:
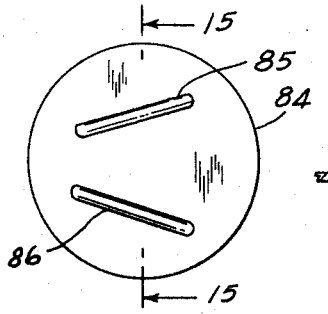
FIG. 14 is a view of a pressure sealing patch used to cover the underside of the closure area to prevent leakage.
Figure 15:
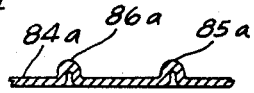
FIG. 15 is a cross-section taken along line 15—15 of FIG. 14.

FIG. 14 shows an aluminum foil patch 84, which has been pressed to raise two ribs 85 and 86. FIG. 15 is a cross-section taken along line 15—15 of FIG. 14, and shows disc 84*a* with raised ribs 85*a* and 86*a*. When the patch is applied to the underside of a can top, the ribs are aligned with the side edges of the opening. They provide slack in the foil, so when the tab is pushed down to open the can, there is no resistance along the side edges, and only at the end. This reduces the amount of pressure required to push the tab down and break the foil.

Figure 16:
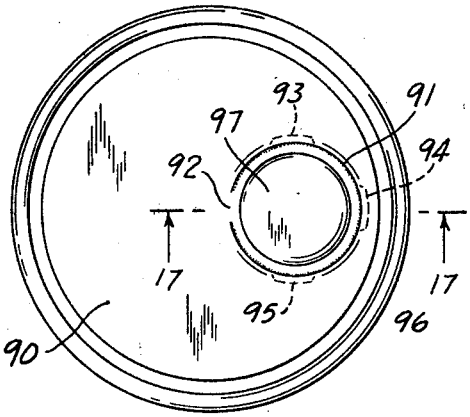
FIG. 16 is a plan view of a can end showing still another closure means in keeping with the invention, and with closure sealed by adhesive.
Figure 17:
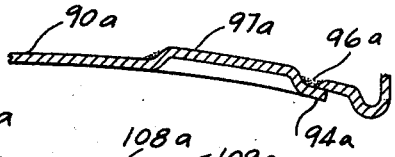
FIG. 17 is a cross-section taken along line 17—17 of FIG. 16.

FIG. 16 is a view of a can top 90 illustrating another form of the invention. A partial hole 91 with rounded edges is punched in the top. The cut extends almost all the way around the circumference, but a narrow section 92 is left uncut to serve as a support when the plug 97 is pushed down to open the container. In a secondary press operation the edges of the central cut-out are expanded outward by impact at three points, 93, 94, and 95. This enlargement of the plug provides engagement with the circular wall of the opening to prevent the plug from moving upward under pressure built up in the can. FIG. 17 is a cross-section taken along line 17—17 of FIG. 16, and shows can top 90*a*, circular cut-out 97*a* with raised center, and overlap 94*a* to hold the plug from upward movement. The plug is sealed around its outer edge by adhesive at 96*a* in FIG. 17, and 96 in FIG. 16. The adhesive may be of the hot melt type, and formulated for limited strength so the button can be pushed down easily with the finger to open the can. It is held in the hinged-down position by connection 92 after opening.

Figure 19:
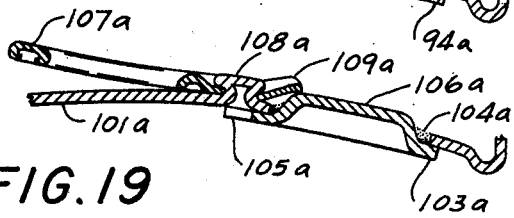
FIG. 19 is a cross-section taken along line 19—19 of FIG. 18.
Figure 18:
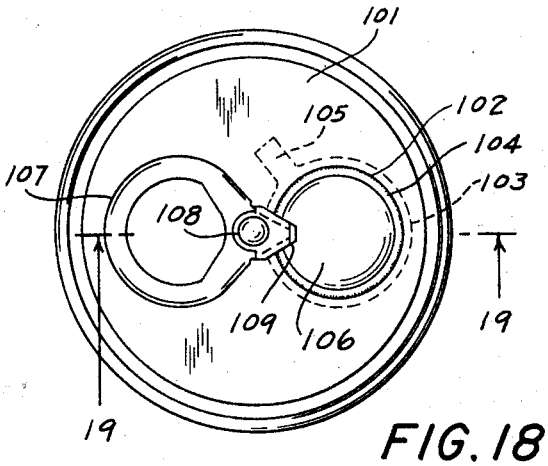
FIG. 18 is a plan view of a can end showing leverage means to assist in opening the closure.

When a plug is sealed in an opening in a container top by an adhesive, it is found that the preferred and easiest opening procedure is to concentrate pressure at one point in the periphery. Once the break starts at this focal point, the rest of the glue line shears off very easily. FIG. 18 is a plan view of can top 101, which has a punched rounded edge hole 102 arranged for an opening for the container for pouring out the contents or drinking direct from the can. FIG. 19 is a cross-sectional view taken along line 19—19 of FIG. 18, and show a raised plug 106*a*, with outer skirt 103*a* which is larger than the opening in the top 101*a*, and the plug has an extension 105*a* which is adhesively secured to the underside of the top. The joint between the plug and the top is sealed by adhesive along line 104*a*. FIG. 18 show these respective parts at 102, 103, 104, 105, and 106, and also shows a ring pull member 107, which is fastened to top 101 by integral rivet 108, and has an extension 109 arranged to press downward with high leverage when the ring is raised. It presses at one point on the plug periphery and starts the break in the adhesive line holding the plug. In FIG. 19 these parts are 107*a*, 108*a*, and 109*a*.

Figure 20:
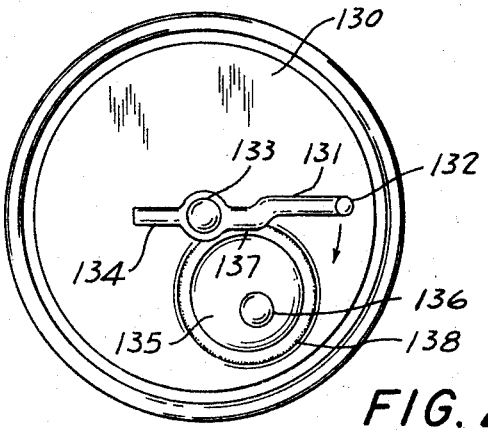
FIG. 20 is a plan view of a can end in which mechanical means are provided to assist in pressing down the closure button.

FIG. 20 shows can top 130 with plug 135, which has a lower skirt larger than the circular opening in the top, and sealed against leakage by adhesive 138. There is a raised point 136 on the top of the plug. An opening bar 131 is provided to make opening easier. It has finger operating extension 132, and is mounted to swivel on integral rivet 133, which is drawn from the cover material external of the opening. Bar 131 has extension 134 to exert pressure against the can top to obtain leverage to press against the plug without tilting the rivet. When arm 131 is moved in the direction of the arrow, shoulder 137 presses first against the crown of the plug, starting to break the adhesive line at this point. Further movement of the bar brings the underside 131 up against crown 136, and this pushes the plug down into the can, where it hangs tilted and held by an adhesively anchored extension, not shown, but similar to that shown in FIG. 18 at 105.

Figure 21:
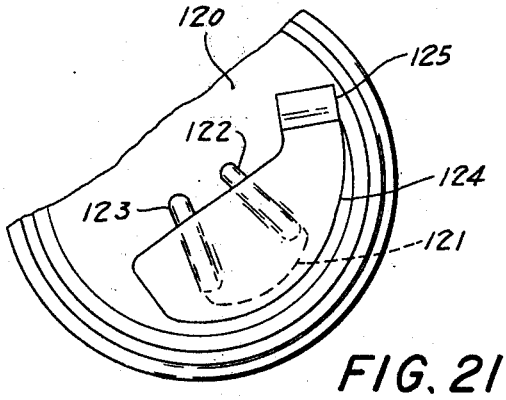
FIG. 21 is a view of a can end with a removeable adhesive patch over the top of the closure to prevent premature opening and to give protection from contamination.

FIG. 21 shows a patch 124 of paper or foil held by pressure sensitive adhesive to the top surface over an opening arrangement such as the one shown in FIG. 2. It serves two purposes, one to keep the area clean where the lips contact it, and the other to prevent pressure from above encountered during shipping and handling from pushing the tab down prematurely.

Figure 22:
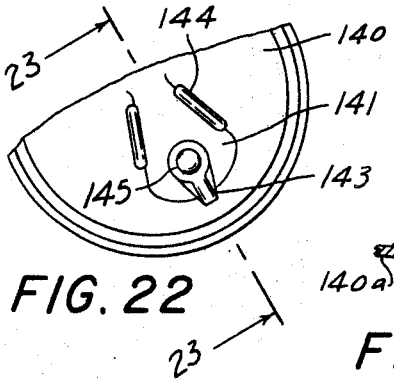
FIG. 22 is a view of a can top end showing a locking device for the openable segment to prevent premature opening.
Figure 23:
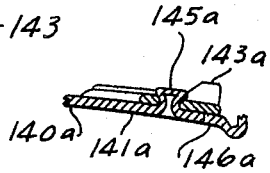
FIG. 23 is a cross-section taken along line 23—23 of FIG. 22, showing further details of construction.

FIG. 22 illustrates a tab safety locking means, It shows can top 140 with openable tab 141, ribs 144, and swivel locking arm 143 mounted on integral rivet 145 which is drawn from the metal of the tab. FIG. 23 is a cross-section taken along line 23—23 of FIG. 22. It shows arm 143*a* on rivet 145*a*, can top 140*a*, tab 141*a*, and the shoulder of the top at 146*a*, where the locking arm engages the shoulder so the tab cannot be pushed down inadvertantly. To open the can, the locking arm is first rotated 180°, and then the tab pushed down. The tab may be sealed by a patch underneath as previously described.

Figure 24:
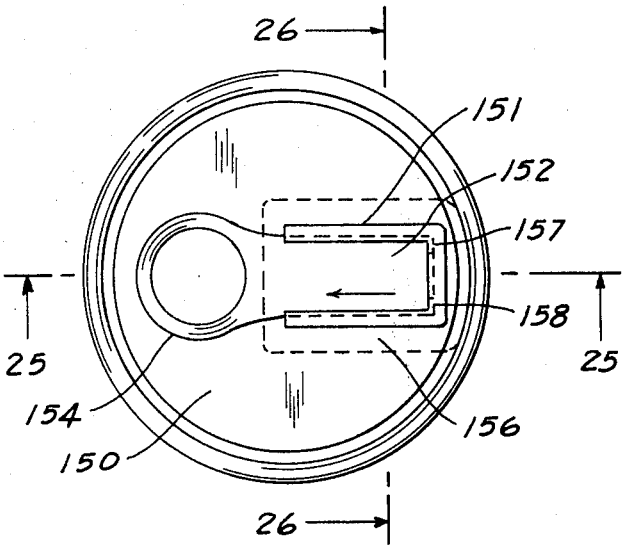
FIG. 24 is a view of a can end showing another form of opening device in accordance with the invention, and which comprises a sliding gate arrangement.

Another method of opening a pressure container, and in which the opening member stays adhered to the can, is shown in FIG. 24, viewed from the top. A can top 150 has a metallic slide member 152, arranged to slide in frame 151. To open the can the slide is drawn over in the direction of the arrow by pulling on ring 154 far enough to expose a pouring or drinking rectangular opening. In this position the slide stays fastened to the can top. At the same time it can be closed again, but not pressure sealed. By making 151 an inserted piece, the can top may be of steel, and 151 of aluminum. Alternatively, the can top may be aluminum, and with the slide guides formed directly in the can top material.

The construction in which the slide guides are formed from the material of the top applies also to other material than aluminum, such as tin plated steel or steel which has any other protective coating. This integral construction is also described again below in connection with FIG. 29, 30, and 31.

Figure 26:
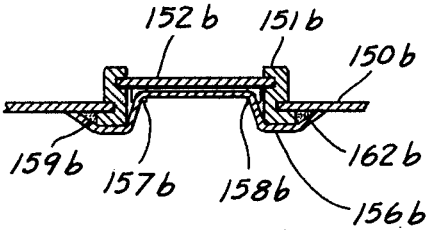
FIG. 26 is a cross-section taken along line 26—26 of FIG. 24, and gives further details on the gate arrangement.
Figure 25:
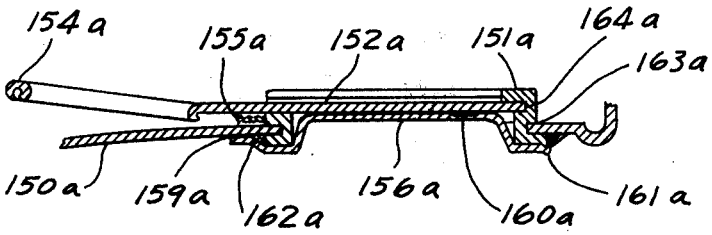
FIG. 25 is a cross-section taken along line 25—25 of FIG. 24, showing how the gate is mounted and sealed against leakage.

Further details are shown in FIG. 25, which is a cross-section taken along line 25—25 in FIG. 24, and FIG. 26, a cross-section along line 26—26 of FIG. 24. An aluminum frame 151 is fitted in a rectangular opening in the can top. Referring to FIG. 25, frame 151*a* has a lower groove 163*a* around four sides and is sealed to top 150*a* by adhesive 162*a*. This frame is formed with an upper groove 164*a* which extends around three sides, but leaving out the groove upper half 151 on the short side at the can center. The metal slide 152*a* slides in this groove, and has ring end 154*a*. Referring to FIG. 24, the slide has two turned down legs at 157 and 158 which serve to break aluminum foil patch 156 as the slide starts to move.

FIG. 26 is a section taken along line 26—26 of FIG. 24. It shows legs 157*b* and 158*b*, and the aluminum foil patch is at 156*b*, held to top 150*b* by adhesive line 159*b* around its periphery. There may also be a metal point formed at 161*a*, FIG. 25, protruding from frame 151*a* on the underside to help start a break in the aluminum with light pulling pressure on ring 154*a*. The foil is also adhered to 152*a* at 160*a*, so as the slide moves out it carries the inner piece of foil with it, and legs 157 and 158 shear the thin foil along the sides of the opening. A weak adhesive is placed at 155*a*, FIG. 25 to prevent the possibility of anything from the outside getting under the slide, and if desired a light wax coating can be placed along the top outside edges of the slide to keep out any foreign substances.

Figure 27:
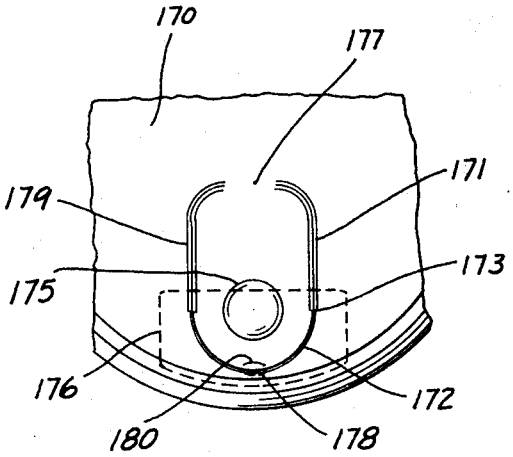
FIG. 27 is a view of a can top end and shows another variation in accordance with the invention, and one in which the segment outline is partly score line and partly cut through the top material.

Still another means to construct the push down segmental arrangement is shown in FIG. 27, which is a plan view of the can top 170. Two score lines 171 and 179 are cut in the metal of the can top. Connecting directly to the ends of the score lines is cut 172, which extends through the thickness of the top. The cut is across the end of the segment and part way up the sides, up to point 173 of score line 171. A boss 175 is formed in the segment and serves as a point on which to exert a pushing pressure with the finger to open the segment. A small bump is formed initially at 180 in the segment, and it is then flattened out after the end cut is made, and with the end of the segment slightly depressed, causing the metal of the segment to extend out at 178. Extension 178 is now just below the metal at the edge of the can top, and it serves to resist internal pressure from pushing the segment up. There can be several extensions similar to 178, or a rib can be pressed in to overlap as in FIG. 7. The open cut 172 is sealed on the underside by an aluminum foil patch 176 adhesively attached to the underside of the top, or alternatively the cut 172 can be sealed by adhesive, preferably on the underside.

This segment is opened by pushing on the boss 175, breaking the foil, and then shearing the metal of the top along the two score lines. After the segment is pushed down, unscored area 177 holds it in its inclined position within the can. By providing a through cut as a starter, it takes much less pressure to shear along a score line. For instance, once the shear is started in this way, it takes only 4 to 5 pounds pressure to push a segment down and shear the two score lines. In the can opening means in common use heretofore, where the score is continuous around the periphery of the segment, it takes 20 to 25 pounds pressure to start a break in the score line, even at the very small arc where the integral rivet and pressure point is usually located near the center of the can.

Figure 28:
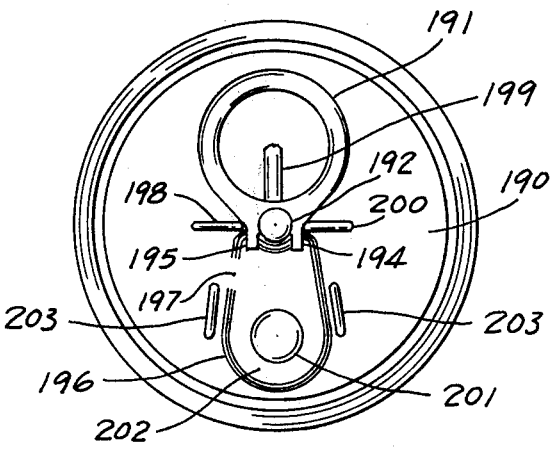
FIG. 28 is a view of a can top with a segment defined by a score line, and with leverage means to start fracture of the score line, and push button means to complete the opening operation.

Another design in keeping with the invention is shown in FIG. 28. A container top 190 has an openable segment 202 defined by a score line 196 which extends around the periphery of the segment except at point 197, where a narrow band of metal remains intact when the closure is opened to support the segment tilted down within the container. A raisable leverage ring arm 191 is secured to the can top by integral rivet 192, which is formed just outside the segment at the score line, and which continues to hold the arm 191 after the segment is opened. it is folded back flat to facilitate drinking from the can.

The score line is brought very close to the rivet, preferably around it, and legs 194 and 195 of the ring arm press with high leverage against the end of the segment when the ring is raised, causing the score line to break, and the end of the segment to move down. Once fracture occurs, the remainder of the segment is pushed down easily by pressing on boss 201.

Figure 29:
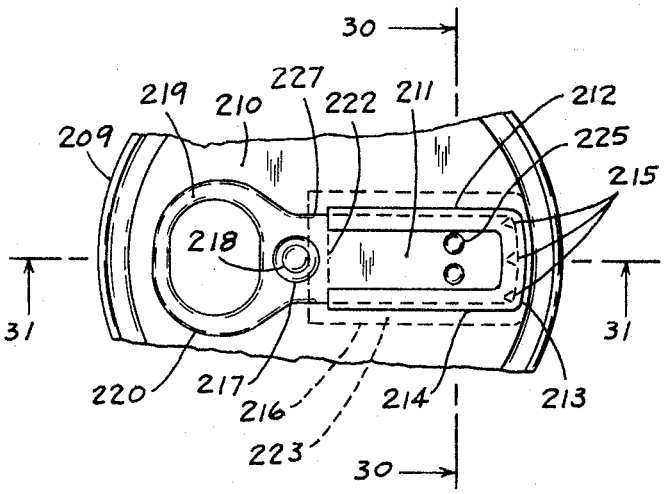
FIG. 29 is a partial plan view of a can end panel showing another form of the sliding gate arrangement in accordance with the invention, and also showing an optional pressure release device.
Figure 30:
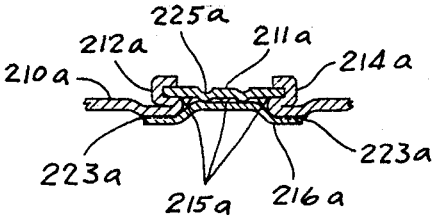
FIG. 30 is a partial cross-section taken along line 30—30 of FIG. 29, showing how the gate guides are formed from the material of the can end panel, and how the gate is sealed.
Figure 31:
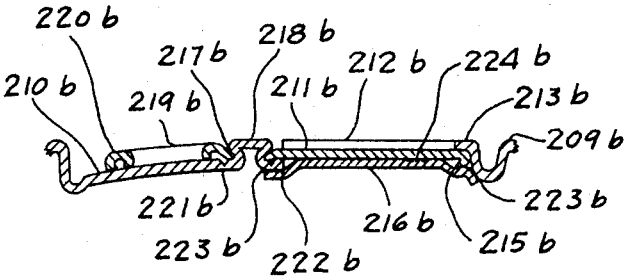
FIG. 31 is a partial cross-section taken along line 31—31 of FIG. 29, showing more details of the construction.

The previously described construction in which a slide member is mounted in a guide frame which is formed from the material of the container top is shown in partial plan view FIG. 29. FIG. 30 is a partial cross-section taken along line 30—30 of FIG. 29, and the same parts are marked with suffix *a*. FIG. 31 is a partial cross-section taken along line 31—31 of FIG. 29, with parts having suffix *b*. Container top 210 with rim 209 has slide frame formed from the material of top 210 and with three grooved sides 212, 213 and 214. Slide 211 fits in the grooves and has pull ring 219 formed with rounded edges 220, which also stiffen the sides down to 227.

Optionally a means may be provided for releasing the internal pressure in the container before pulling the slide open. Such a means comprises a small circular easy open segment defined by score line 221*b*. Integral rivet 218 is formed from the metal within the score line, and slide 211 has semi-spherical depression 217 which serves to provide lifting leverage to rupture score line 221 when the ring is raised to start opening the container. Downward projecting dents 225 formed in the slide are positioned to limit the outward movement of the slide when they reach edge 222 to prevent the slide from coming out all the way.

The opening area is sealed by frangible membrane 216, which may be of aluminum foil or other material, and which is sealed airtight all around by adhesive 223. The adhesive may be plastisol, hot melt, polyvinyl chloride, or other type suitable for use with the contents of the container. A plurality of sharp points 215 project downward and are formed on the inner edge of slide 211. They serve to part the membrane when the slide is pulled for opening, and are preferably curved as shown in FIG. 31 at 215*b* so internal pressure does not cause premature rupture of the membrane. Adhesive at 224*b* insures that the inner section of the cut membrane moves out with the slide as the membrane is slit progressively along either side by outer sharp points 215. The membrane may preferably by aluminum foil or tin foil. It is applied with a little slack in such a way that the slide can move out more or less freely until points 215 dig into the foil and initiate tearing it across the end. The membrane may also be attached by pressure sensitive adhesive.

Figure 32:
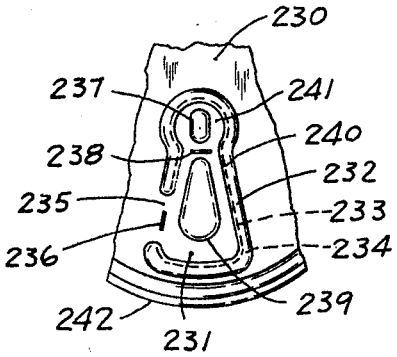
FIG. 32 is a partial plan view of a can end panel showing another form of the invention, and which provides an initial pressure release button area at one end of the segment.

An advantageous design of push in closure is shown in FIG. 32. Closure 231 has an elongated shape with the wider part near the can rim 242, and is cut from the material of container top 230, leaving an uncut attachment section 235. A short section of score line may be formed in section 235 at 236 to make opening easier. The material of 230 is formed into a ridge around the periphery of the opening at 232 to form an opening with rounded edges and to provide a hollow channel underneath for sealant. To withstand internal pressure the outer periphery of the segment, shown dotted at 233, is made larger than opening 240. If the top is of ductile metal this is done by refoming after the peripheral cut is made, either by decresing the size of the opening or by enlarging the segment, or both. A line of plastisol or other frangible sealant forms an airtight seal around the periphery underneath at 234. Raised areas 237 and 239 facilitate pushing down with the finger.

One advantage of the FIG. 32 arrangement is that initial rupture is much more easily attained by pushing down first on small end 237, which releases any internal pressure. Because of the small area at 241, internal pressure gives minimal resistance, and also the small arc of sealant is easily ruptured. Optional score line 238 makes bending down of the end take less force. Once rupture of a sealant line is started, progressive breaking along the line is easy, and as a result completion of opening by pushing down with the finger on area 239 takes very little force.

Figure 33:
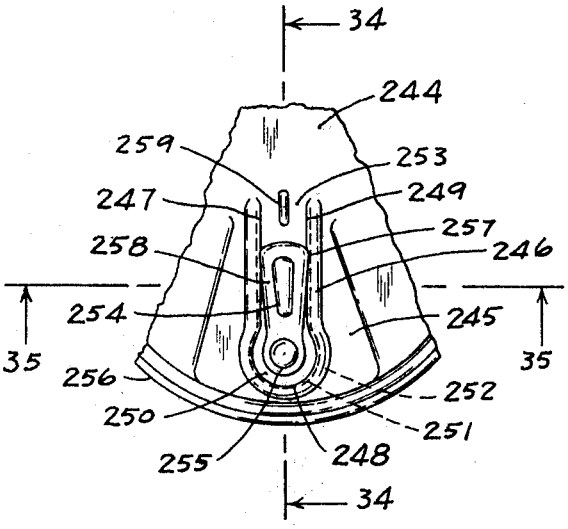
FIG. 33 is a partial plan view showing another very desirable form of the invention, and which provides a small tab attached to an end of the segment to assist the manual opening operation.
Figure 34:
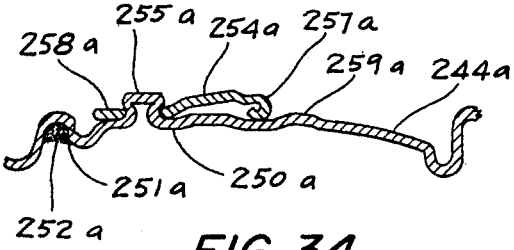
FIG. 34 is a partial cross-section taken along line 34—34 of FIG. 33 giving more details of construction.
Figure 35:
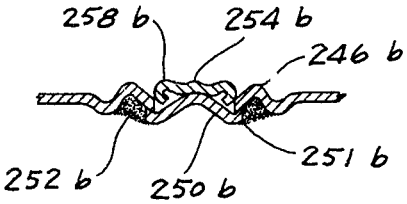
FIG. 35 is a partial cross-section taken along line 35—35 of FIG. 33 showing the metal overlapping and sealing details.
Figure 36:
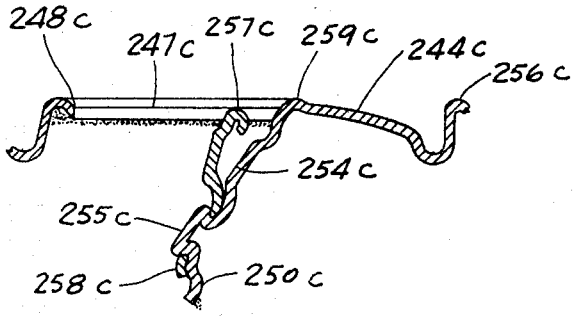
FIG. 36 is a partial cross-section similar to FIG. 34, but showing the final position of the segment and the tab after opening.

FIG. 33 shows a highly preferred arrangement of push in closure made in accordance with the invention, and which has a light and low cost lift tab to facilitate opening. The lift tab assists in the opening operation by providing leverage and also serving to eliminate any possibility of danger to the user, such as a finger getting stuck in the opening when trying to push the segment down with a finger. FIG. 34 is a cross-section along line 34—34, and FIG. 35 is a cross-section along line 35—35, both of FIG. 33 before opening. FIG. 36 is a cross-section similar to FIG. 34, but showing the position of the closure and the lift tab after opening. Container top 244 has raised area 245 so gases instead of liquid will be in this region and internal pressure can be released near the rim. Closure 250 is cut from the material of top 244 to form an opening. The area of the opening near the rim at 248 is large enough for drinking or pouring, and may be circular or any other shape. The opening extends from 248 toward the center of the container to admit air when drinking or pouring. The preferred shape of the extension is with two parallel sides 247 and 249. An uncut section 253 at the inner end serves to anchor the closure to the top when it is hinged down to open. Sides 247 and 249 need not be parallel their whole length, but should preferably be parallel toward the center.

The closure is larger than the opening as shown in FIG. 35. The edges of the opening are rounded at 246*b*, and hollow underneath for frangible sealant 252*b*. Or an adhesively held membrane may be used instead of the adhesive sealant. The edges of the closure at 251*b* extend out beyond the edges of the opening to resist upward internal pressure.

A lift tab 258 is attached to the outer end of the segment, preferably by integral rivet 255. The center of the lift tab at 254 may be grooved on the underside to match the center ridge of segment 250 to keep the tab in alignment. The width of the outer end of the tab at 257 may be made slightly larger than the space between the parallel section walls 247 and 249.

Now to open the container, the lift tab is raised, and this bends down the outer edge of the circular section of the closure near the rim, rupturing the sealant, and releasing internal pressure with a pop, which is desirable to keep liquid from squirting out. This is a big advantage over the small separate push button used heretofore to release the pressure. The lift tab is then pushed on down to complete the opening, and with very little force required to progressively tear the two lines of sealant to point 253. The final open position of tab and segment is shown in FIG. 36. The length of the lift tab is designed so it can be pushed all the way through the opening, and once through, it can not come back up because the outer end is wider than the opening between sides 247 and 249 by a slight amount.

The outer end of the tab is then flush with the top of the container, or slightly below, so there is no interference with the user's nose when drinking from the can. A small raised rib 259 in area 253 serves to increase the radius of curvature at the hinge point when the segment bends down and insures against breaking off and the parts falling into the can.

Figure 41:
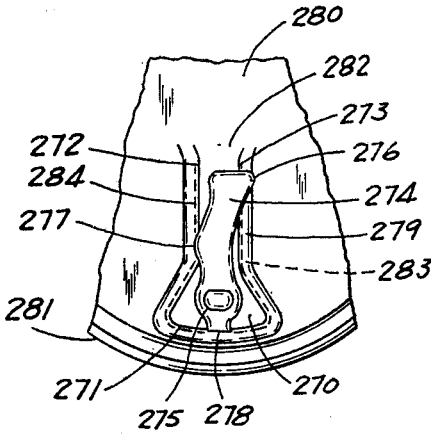
FIG. 41 is a partial plan view of a can end panel showing an alternative and very desirable construction of easy open means using a tab attached to one end of an elongated segment.
Figure 37:
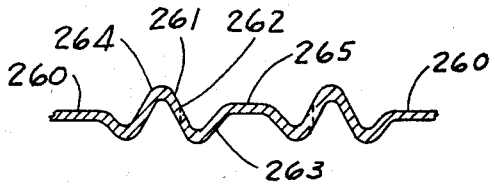
FIG. 37 is a partial cross-section in an area similar to FIG. 35, but showing an initial step in the method of press forming the metal of the can end panel.

FIG. 41 shows an alternative design in which closure segment 270 is also larger than the opening in container top 280 at 284, with rim 281. The opening has an outer end 271 for drinking or pouring, and with side walls 272 and 273 extending toward the container center, and they may be parallel as shown. The edges of the opening are crowned at 279, and sealant 283 is underneath. Uncut section 282 acts as a hinge. Lift tab 274 is slightly narrower at its outer end 276 than the space between 272 and 273, but it is positioned slightly offset and held from rotation by oval rivet 275. Then when the closure and lift tab are pushed down, and the outer end of the lift tab goes below the side walls of the opening, it springs slightly to one side. it catches on the edge of the opening and will not come up again, but stays substantially flush or even below so as not to interfere with the user's nose.

The off-set at 276, and another off-set at 277, plus an optional projection at 278, all serve to block the closure against inadvertent opening during shipping or handling of the container. Extension 278 also serves to keep the tab from being too easy to raise when first opening the closure.

Figure 38:
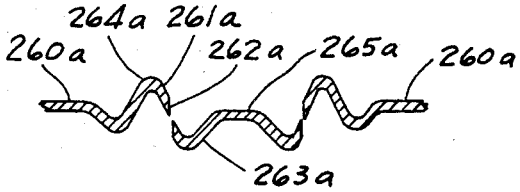
FIG. 38 is a partial cross-section in the area similar to FIG. 37, and showing a subsequent step in the method of press forming and cutting the metal of the end panel.
Figure 40:
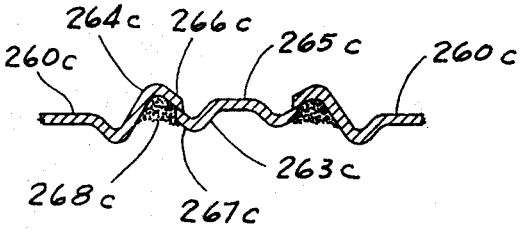
FIG. 40 is a partial cross-section in the area similar to FIG. 37, and showing a still later step in the method of press forming, and then adhesively sealing the metal of the end panel.

FIG. 37, 38, 39, and 40 show cross-sections of a closure segment at a pont similar to FIG. 36, and illustrate a simple method for forming the ductile metal material of a container top to make the closure segment larger than the opening from which it is cut. By press forming operations, including an initial bulge draw to provide enough material, the metal of top 260 is die formed to the contour in FIG. 37, forming ridges 264 having inner slopes 261, and closure segment 263 with center bulge 265. The cut is made at 262, shown dotted, in the next step. FIG. 38 shows the cuts at 262*a*, after which the segment 263*a* is moved down as shown so the edges clear. Successive forming gives the FIG. 39 contours in which the inner slopes of the walls of ridges 264*b* are raised upward as at 266*b*, thereby serving to make the opening smaller than the width of the segment cut therefrom. The edges of the segment may also be bent down as at 267*b* to enlarge the segment to further increase the overlap and to make the angled surfaces parallel. In the final forming step, as shown in FIG. 40, the segment is raised to bring 266*c* and 267*c* together, and then adhesive sealant 268*c* is applied to make the closure airtight. Optionally the closure may be sealed by laminar material secured be adhesive around the periphery of the opening to the metal of the container top externally of the opening.

The type of lift tab construction shown in FIG. 33 and in FIG. 41, in which the lift tab is attached by means such as an integral rivet to the segment itself near one edge, and whereby raising the lift tab initiates rupture of the sealant in one localized area through leverage, may also be used for any other shape or type of closure segment. For instance a lift tab can be used on the FIG. 16 design attached by rivet near the rim side of closure 97 to start rupture of a laminate or sealant near 94, and then the tab pushed downward to complete the opening.

Or a lift tab can be used in the FIG. 27 arrangement, attaching it near the rim side of portion 175. The FIG. 27 segment is defined by part score line and part cut through the material and with the size of the opening decreased at one point. This type can be made easier to open with a lift tab attached near the rim and near 175.

Figure 42:
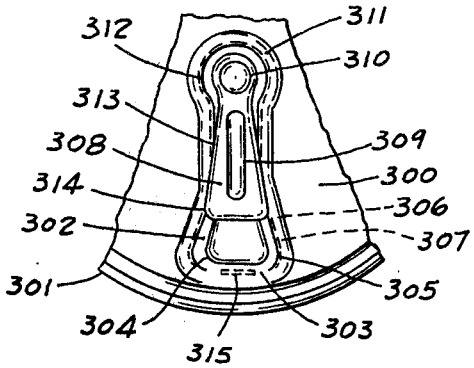
FIG. 42 is a partial plan view showing an alternative construction with the lift tab attached at the inner end of the closure.
Figure 39:
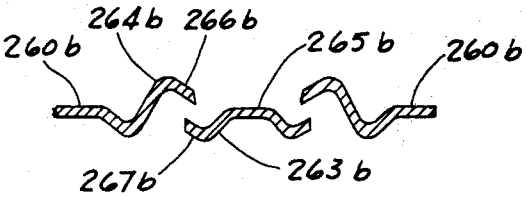
FIG. 39 is a partial cross-section similar to FIG. 37, and showing a later step in the method of press forming the metal of the end panel.

FIG. 42 shows another preferred form in a partial plan view of container top 300 with rim 301. A closure 302 is cut from the material of the top, and with uncut section 303 for hinging attachment. A ridge 311 is formed around the periphery of the opening cut, and is hollow underneath at 306 where frangible sealant 307 seals the closure to the container top. The opening is made smaller than the segment, and the overlapping edge of segment 302 is 305. A lift tab 308 is provided to assist in opening the closure, and is attached to the inward end of the segment by integral rivet 310. Tab 308 has rounded edges giving stiffness and rib 309 which extends downward to prevent misalignment. Tab 308 is wider than the opening at 313 to 314 to provide against inadvertent opening from downward pressure.

To open the container the lift tab is raised and this bends down the edge of the segment at its inner end, starting rupture of the sealant, and releasing any internal pressure. The closure is then pushed on down by the lift tab, and the wider opening at 312 permits the end 314 of the tab to pass through and go below the container top, where it catches under the edge of the opening, holding it down flush. This prevents interference with the user's nose if drinking from the can. A depression 304 gives more space to grasp the end of the tab, after opening provides clearance for flow of liquid near the rim. Optionally, hinge connection 303 can have a score line at 315 to facilitate bending down, and along a line closer to the rim. 315 is shown on the underside to lessen possibility of break-off. Sealing is preferably by adhesive sealant, or a membrane may be used. The lift tab may be positioned off at an angle rather than on the center-line before opening, if desired.

Figure 43:
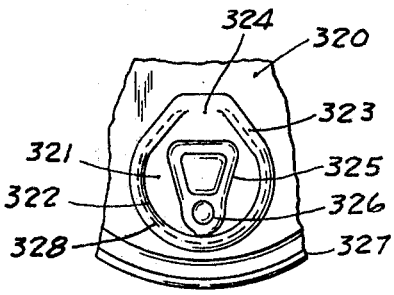
FIG. 43 is a partial plan view showing a very simple form of closure with a small lift tab to assist in opening.

FIG. 43 shows a simplifed form of the invention. Container top 320, with rim 327, has closure 321, which is slightly larger at 328 than the opening 322, and is attached at the top by un-cut hinge section 324. The walls around the opening at 323 provide rounded edges and a hollow space underneath for a frangible sealant to seal the closure to the top against leakage. Lift tab 325 is attached to the closure by rivet 326, and provides leverage to initiate rupture of the sealant, and then both the closure and the tab are pushed on down below the surface of the top to complete the opening.

In the claims the closure is described as being in the "top" of the container, and this is the position in which opening is normally done, but the container may be stored with the top wall in this or any other position.

In the claims the term "frangible sealing means" covers sealing the opening by any means, including and preferably for the push-in types, an adhesive type sealant, or by an adhesively attached membrane or thin laminar material. In the claims the term "frangible adhesive sealant" covers any type of sealant that will adhere to the material of the top and the closure, and that can be ruptured to open. The adhesive used must be compatible with the product to be packaged in the container.

Preferred adhesive sealants are the plastisols, as they form a semi-flexible sealing line that can be ruptured initially at a local point without requiring excessive force. Plastisol is a dispersion of fine particle size PVC type resin in a plasticizer, and requires heat curing. Resins include polyvinyl chloride, a vinyl chloride copolymer, a vinyl chloride-vinyl acetate copolymer, or other, and esters may be used as the plasticizer. Foamed plastisol may be used in whole or in combination with unfoamed plastisol.

The adhesive may be hot melt, containing waxes, cellulose esters and ethers, polyvinyl esters and acetals, and certain polymides, etc. Many other types of adhesives may be suitable. Membranes may be of any tearable type, an d are especially suited to the slide type of opener. The membrane may be adhered by pressure sensitive adhesive, or other types. The pressure release device optionally used with the slide opener may comprise an adhesively sealed plug rather than the small score line segment previously described, if desired.

The container top and the closure may either one or both be made of plastic, and the parts may be compression moulded. Sealing means may be as described previously, or may be a thin connection of plastic integrally formed between the two parts. The lift tab in any of the species may be of metal or plastic, and may be attached by rivet, integral rivet, welding, or other means.

In the claims the term "elongated U-shaped loop" does not restrict the shape to one having only parallel sides, and the loop may have a wider section at either end, or at both ends, as may be necessary to provide a large enough product discharge opening, or to allow enough lateral space for passage of the end of the lift tab to below the container top.

In the claims covering the slide gate closure, the pull tab is preferably integral with the slide gate and in the form of a ring or corrugated tab, but it may be separately formed and secured to the gate, as by a rivet. Each of the various parts, including the container top wall, may of aluminum, steel, with or without tin plating, or plastic, and different parts may be of different materials. The membrane sealing means may be aluminum foil, tin foil, plastic, or other suitable material that is sufficiently frangible to rupture easily on opening. The slide gate may be uniformly flat, or have off-set contours or ribs for stiffening extending across or lengthwise.

It will be apparent that while I have shown and described the invention in several preferred forms, changes may be made without departing from the scope of the invention, as sought to be defined in the following claims.

What I claim is:

1. An easy open container having a top wall, and having a body which is attached to said top wall along its periphery and defining a rim, and with easy opening slide gate closure means in said container top wall, said easy opening means comprising, a. an opening in said container top wall, and with two opposite sides of said opening each having slide gate grooved guide means thereon, b. said slide gate grooved guide means extending along at least part of the length of each of said opposite sides of said opening, and with the grooving in said grooved guide means on one side being substantially parallel to the grooving in said grooved guide means on the opposite side of said opening, c. a slide gate positioned in said grooved guide means and bridging said opening, and being larger than said opening.

d. a pull tab means connected to said slide gate for manual pulling of said slide gate to open said container closure, e. frangible membrane sealing means positioned on the underside of said container top wall, and extending over said opening and beyond and around the periphery of said opening, and being adhesively secured to top wall material all around and outward of said opening, and making said container top closure airtight, f. engagement means between said slide gate and said frangible membrane, said engagement means causing a relatively small part only of said frangible membrane to move with said slide gate when said slide gate is drawn over to open said closure means, and thereby to assist in rupturing said frangible membrane to form an opening, and e. means to limit the axial sliding movement of said slide gate so said slide gate remains at least partially engaged in said grooved guide means, and remains attached to said container top wall after opening.

2. An easy open container as defined in claim 1 in which there are also guide means extending crosswise at the end of said opening which is away from said pull tab means, and in which said opening is positioned in said container top wall with this end near said rim, and with the two said opposite sides of said opening extending from near said rim toward the inner region of said container top wall.

3. An easy open container as defined in claim 1 in which said engagement means includes at least one downwardly directed projection provided in the end region of said slide gate and at the end near said rim, and to assist in rupture of said frangible membrane during the opening operation.

4. An easy open container as defined in claim 1 in which said engagement means includes downwardly directed projections near the side edges of said slide gate to assist in cutting said frangible membrane along the sides of said opening as said slide gate is moved axially to open said closure.

5. An easy open container as defined in claim 1 in which said container top wall is made of plastic.

6. An easy open container as defined in claim 1 in which said grooved guide means comprises a non-integral separately formed framework which is inserted in said container top wall and extending along the borders of said opening, and which is adhesively secured in place.

7. An easy open container as defined in claim 1 in which a small size openable section is provided in said container top wall under said pull tab means, and with said openable section secured to said pull tab means, and with leverage means so raising said pull tab means will rupture said small openable section to release internal pressure in said container just before pulling said slide gate to open said container.

8. An easy open container as defined in claim 1 in which said engagement means includes adhesive attachment of part of the interior region of said frangible membrane to said slide gate to assist in rupturing said frangible membrane as said slide gate is drawn over to open said slide gate closure means.

9. In an easy open container having a top wall with easy opening slide gate closure means in said top wall, said slide gate closure means comprising, an opening in said container top wall, a slide gate at least part of which is larger than said opening and is positioned below said opening, and bridging said opening, guiding means to maintain said slide gate in substantial axial alignment as said slide gate is slid over to open said container, actuator extension means on said slide gate for application of manual force to effect sliding of said slide gate to open said container, restricting means to limit the extent of the sliding movement of said slide gate, and which in combination with said guiding means causes said slide gate to remain attached to said container top wall after opening, and frangible membrane sealing means positioned on the underside of said container top wall and below said slide gate, and extending over said opening and beyond all around the periphery of said opening, and being adhesively secured to top wall material all around and outward of said opening, and effecting sealing of said slide gate closure means against leakage.

10. An easy open container having a top wall with easy opening slide gate closure means in said top wall, said slide gate closure means comprising, an opening in said container top wall, a slide gate at least part of which is larger than said opening and is positioned below said opening, and bridging said opening, guiding means to maintain said slide gate in substantial axial alignment as said slide gate is slid over to open said container, actuator extension means on said slide gate for application of manual force to effect sliding of said slide gate to open said container, restricting means to limit the extent of the sliding movement of said slide gate, and which in combination with said guiding means causes said slide gate to remain attached to said container top wall after opening, frangible membrane sealing means positioned on the underside of said container top wall and below said slide gate, and extending over said opening and beyond all around the periphery of said opening, and being adhesively secured to top wall material all around and outward of said opening, and effecting sealing of said slide gate closure means against leakage, and engagement means between said slide gate and said frangible membrane, said engagement means causing part of said frangible membrane to move with said slide gate when slide gate is drawn over to open said closure means, and thereby to assist in rupturing said frangible membrane to form an opening.

11. An easy open container as defined in claim 10 in which said frangible membrane sealing means comprises a membrane of metal foil adhesively secured.

12. An easy open container as defined in claim 10 in which said container top wall is made of sheet metal, and in which said guiding means are integrally formed from material of said container top wall.

13. An easy open container as defined in claim 7 in which said sheet metal top wall is made of aluminum.

14. An easy open container as defined in claim 12 in which said sheet metal top wall is made of steel.

15. An easy open container as defined in claim 10 in which said engagement means includes adhesive attachment of part of the interior region of said frangible membrane to said slide gate to assist in rupturing said frangible membrane as said slide gate is drawn over to open said slide gate closure means.

16. An easy open container as defined in claim 10 in which said engagement means includes at least one projection from said slide gate to assist in rupturing said frangible membrane as said slide gate is drawn over to open said slide gate closure means.

17. An easy open container as defined in claim 10 in which said engagement means includes at least one downwardly directed projection from said container top wall near the end region of said slide gate, and which end region is near said rim, and to assist in the rupture of said frangible membrane at the start of the axial movement of said slide gate to open said slide gate closure means.

* * * * *